US010172448B2

(12) United States Patent
White et al.

(10) Patent No.: US 10,172,448 B2
(45) Date of Patent: Jan. 8, 2019

(54) MODULAR ARMORED LECTERN

(71) Applicant: Defenshield, Inc., St. Augustine, FL (US)

(72) Inventors: William Collins White, St. Augustine, FL (US); Jordan William Settle, St. Augustine, FL (US)

(73) Assignee: DEFENSHIELD, INC., St. Augustine, FL (US)

( * ) Notice: Subject to any disclaimer, the term of this patent is extended or adjusted under 35 U.S.C. 154(b) by 0 days.

(21) Appl. No.: 15/662,330

(22) Filed: Jul. 28, 2017

(65) Prior Publication Data

US 2018/0027958 A1 Feb. 1, 2018

Related U.S. Application Data

(60) Provisional application No. 62/368,285, filed on Jul. 29, 2016.

(51) Int. Cl.

| | |
|---|---|
| ***A47B 19/10*** | (2006.01) |
| ***F41H 5/24*** | (2006.01) |
| ***F41H 5/013*** | (2006.01) |
| ***A47B 19/02*** | (2006.01) |
| ***A47B 19/00*** | (2006.01) |
| ***F41H 5/06*** | (2006.01) |

(52) U.S. Cl.

CPC ..... *A47B 19/10* (2013.01); *A47B 19/00* (2013.01); *A47B 19/02* (2013.01); *F41H 5/013* (2013.01); *F41H 5/06* (2013.01); *F41H 5/24* (2013.01)

(58) Field of Classification Search

CPC ..... A47B 19/00; A47B 19/10; A47B 19/02; F41H 5/013; F41H 5/06; F41H 5/24

USPC ..... 108/161, 50.11

See application file for complete search history.

(56) References Cited

U.S. PATENT DOCUMENTS

| | | | | |
|---|---|---|---|---|
| 6,170,379 | B1 * | 1/2001 | Taylor | F41H 5/08 312/196 |
| 6,325,343 | B1 * | 12/2001 | Flagg | A47B 19/08 248/174 |
| 6,622,607 | B1 * | 9/2003 | Miller | F41H 5/06 2/2.5 |
| 6,907,811 | B2 * | 6/2005 | White | F41H 5/06 109/49.5 |
| 7,520,207 | B1 * | 4/2009 | Fuqua | F41H 5/013 109/82 |
| 7,891,283 | B2 * | 2/2011 | Kleniatis | F41H 5/14 89/36.09 |
| D661,920 | S * | 6/2012 | Arnold | D6/700 |
| 8,549,979 | B2 * | 10/2013 | Spransy | F41H 5/013 89/36.07 |
| 9,528,797 | B2 * | 12/2016 | Harwood | F41H 5/08 |

(Continued)

*Primary Examiner* — Jose V Chen

(74) *Attorney, Agent, or Firm* — Baker & Hostetler LLP

(57) ABSTRACT

An armored lectern includes a frame, a first armored panel, and a second armored panel. The frame defines a gap, and the armored lectern defines an assembled configuration in which a portion of the first armored panel is positioned within the gap such that a first panel surface of the first armored panel faces a first direction, a first portion of the second armored panel is positioned within the gap such that the first panel surface of the second armored panel faces the first direction, and a second portion of the first panel surface of the second armored panel faces a second panel surface of the first armored panel.

20 Claims, 6 Drawing Sheets

(56) References Cited

U.S. PATENT DOCUMENTS

| | | | | |
|---|---|---|---|---|
| 2008/0043386 | A1* | 2/2008 | Atlas | A47B 9/04 361/33 |
| 2010/0096959 | A1* | 4/2010 | Weaver | A47B 19/02 312/109 |
| 2015/0033990 | A1* | 2/2015 | Yeager | A47B 85/06 108/15 |
| 2015/0096471 | A1* | 4/2015 | Kyler | E06B 7/28 108/15 |
| 2015/0153143 | A1* | 6/2015 | Hollenbach | F41H 5/24 89/36.01 |

* cited by examiner

MODULAR ARMORED LECTERN

CROSS REFERENCE TO RELATED APPLICATIONS

This application claims the benefit of U.S. Provisional Patent Application No. 62/368,285 filed Jul. 29, 2016, the disclosure of which is hereby incorporated by reference in its entirety.

TECHNICAL FIELD

The present disclosure relates generally to barriers, and more specifically to an armored lectern including modular units of ballistic resistant material.

BACKGROUND

People often use a lectern during delivery of a speech. In some situations it may be advantageous for a speaker to use a lectern with ballistic resistant properties such that the speaker is protected from ballistics fired toward the speaker while using the lectern. However, a lectern with ballistic resistant properties may be heavy, and therefore difficult to move. An armored lectern that is configured to be assembled in one location, then either moved, or disassembled and then moved to another location, may be desired.

SUMMARY

The present application discloses in accordance with one embodiment, an armored lectern configured to protect a first side of the armored lectern from ballistic projectiles fired from a second side of the armored lectern that is opposite the first side with respect to a first direction. The armored lectern includes a frame including a first channel member, the first channel member having a first side wall and a second side wall, the second side wall spaced from the first side wall in the first direction by a frame width, and the first channel member defines a gap between the first side wall and the second side wall. The armored lectern further includes a first armored panel having a first panel surface and a second panel surface opposite the first panel surface, the first armored panel configured to prevent a ballistic projectile that strikes the first panel surface from penetrating through the second panel surface, the first armored panel defining a first panel width measured from the first panel surface to the second panel surface along the first direction. The armored lectern further includes a second armored panel having a first panel surface and a second panel surface opposite the first panel surface of the second armored panel, the second armored panel configured to prevent a ballistic projectile that strikes the first panel surface of the second armored panel from penetrating through the second panel surface of the second armored panel, the second armored panel defining a second panel width measured from the first panel surface of the second armored panel to the second panel surface of the second armored panel along the first direction. Wherein the frame width is greater than a summation of the first panel width and the second panel width, and the armored lectern defines an assembled configuration in which: 1) a portion of the first armored panel is positioned within the gap such that the first panel surface of the first armored panel faces the first side, 2) a first portion of the second armored panel is positioned within the gap such that the first panel surface of the second armored panel faces the first side, and 3) a second portion of the first panel surface of the second armored panel faces the second panel surface of the first armored panel.

The present application further discloses in accordance with another embodiment, an armored lectern including a frame, a first armored panel, and a second armored panel. The frame includes a first channel member, a second channel member, and a vertical support member. The first channel member includes a first side wall and a second side wall, the second side wall spaced from the first side wall in a first direction such that the first channel member defines a first gap between the first side wall and the second side wall. The second channel member is spaced from the first channel member along a second direction that is substantially perpendicular to the first direction, the second channel member includes a third side wall and a fourth side wall, the third side wall spaced from the fourth side wall in the first direction such that the second channel member defines a second gap between the third side wall and the fourth side wall. The vertical support member includes a fifth side wall and a sixth side wall, the fifth side wall spaced from the sixth side wall in the first direction such that the vertical support member defines a third gap between the fifth side wall and the sixth side wall. The first armored panel is configured to be positioned at least partially within the third gap, the first armored panel includes a first panel surface and a second panel surface opposite the first panel surface along the first direction when the first armored panel is positioned at least partially within the third gap, and the first armored panel is configured to prevent a ballistic projectile that strikes the first panel surface from penetrating through the second panel surface. The second armored panel is configured to be positioned partially within both the first gap and the second gap. The second armored panel includes a first panel surface and a second panel surface opposite the first panel surface of the second armored panel, the second armored panel is configured to prevent a ballistic projectile that strikes the first panel surface of the second armored panel from penetrating through the second panel surface of the second armored panel. Wherein the armored lectern defines an assembled configuration in which at least a portion of the second armored panel is positioned farther from the vertical support member with respect to a third direction, which is substantially perpendicular to both the first direction and the second direction, than an entirety of the first armored panel is from the vertical support member with respect to the third direction.

The present application further discloses in accordance with another embodiment, a method of assembling an armored lectern is provided. The method includes the steps of positioning a portion of a first armored panel within a gap of a first channel member such that a first panel surface of the first armored panel faces the first side and a second panel surface of the first armored panel faces the second side, the gap defined between a first side wall of the first channel member and a second side wall of the first channel member spaced from the first side wall of the first channel member in the first direction, and positioning a portion of a second armored panel within the gap of the first channel member such that both a first portion of the first panel surface of the second armored panel faces the first side, and a second portion of the first panel surface of the second armored panel faces the second panel surface of the first armored panel.

BRIEF DESCRIPTION OF THE DRAWINGS

The foregoing summary, as well as the following detailed description of illustrative embodiments of the armored lectern of the present application, will be better understood when read in conjunction with the appended drawings. For the purposes of illustrating the armored lectern of the present application, there is shown in the drawings illustrative embodiments. It should be understood, however, that the application is not limited to the precise arrangements and instrumentalities shown. In the drawings.

DETAILED DESCRIPTION OF ILLUSTRATIVE EMBODIMENTS

Figure 2:
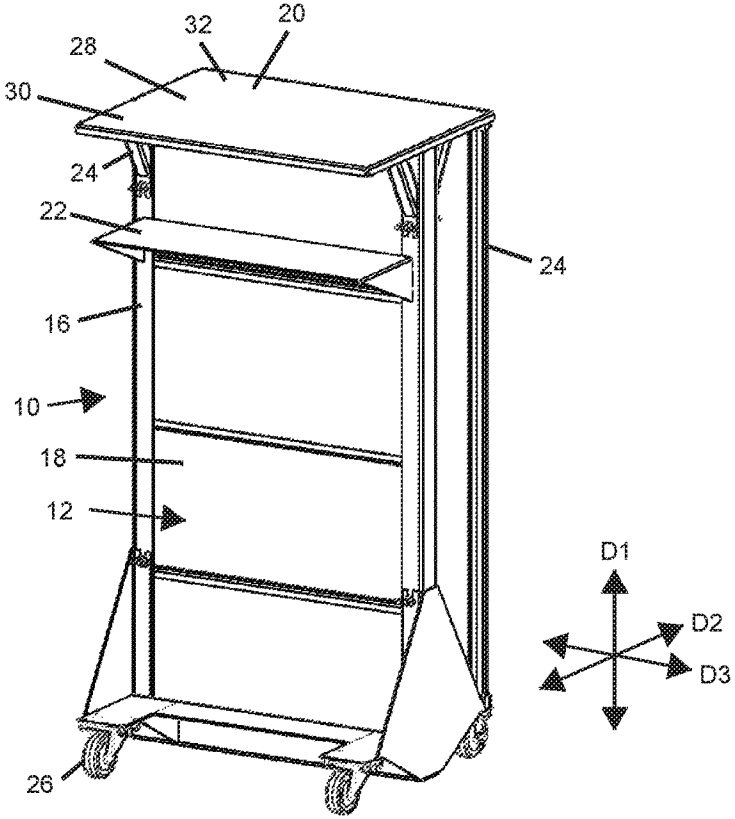
FIG. 2 is a rear isometric view of the armored lectern illustrated in FIG. 1.

Certain terminology is used in the following description for convenience only and is not limiting. The term "plurality", as used herein, means more than one. The words "above" and "below" designate directions in the drawings to which reference is made. When a range of values is expressed, another embodiment includes from the one particular value and/or to the other particular value. Similarly, when values are expressed as approximations, by use of the antecedent "about," it will be understood that the particular value is included in the embodiment.

Further, reference to values stated in ranges includes each and every value within that range. All ranges are inclusive and combinable. Certain features of the invention which are described herein in the context of separate embodiments may also be provided in combination in a single embodiment. Conversely, various features of the invention that are described in the context of a single embodiment may also be provided separately or in any subcombination.

Figure 1:
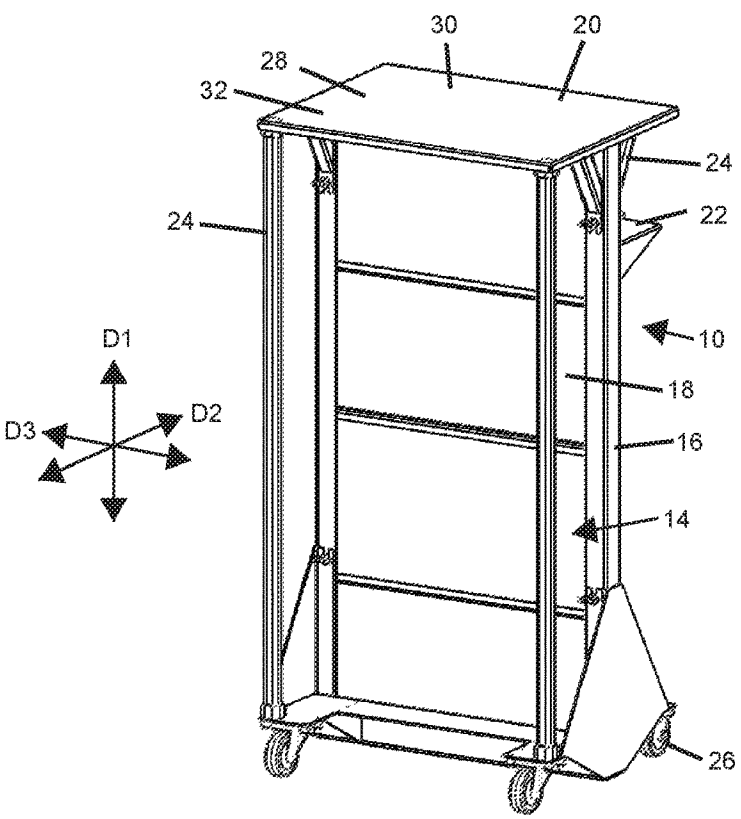
FIG. 1 is a front isometric view of an armored lectern according to one embodiment.

Referring to FIGS. 1 and 2, an armored lectern 10 is configured for use by a person such that when the person is positioned on one side of the armored lectern 10, the person is protected from ballistics fired from another side of the armored lectern 10. As shown in the illustrated embodiment, the armored lectern 10 defines a first side 12 and a second side 14 that is opposite the first side 12. According to one aspect of the disclosure, the armored lectern 10 is configured such that a person positioned on the first side 12 of the armored lectern 10 is protected from ballistics fired from the second side of the armored lectern 10.

According to one aspect of the disclosure, the armored lectern 10 includes a frame 16 and at least one armored panel 18. As shown in the illustrated embodiment, the armored lectern 10 includes a plurality of armored panels 18, and the frame 16 is configured to support each of the plurality of armored panels 18.

Figure 4:
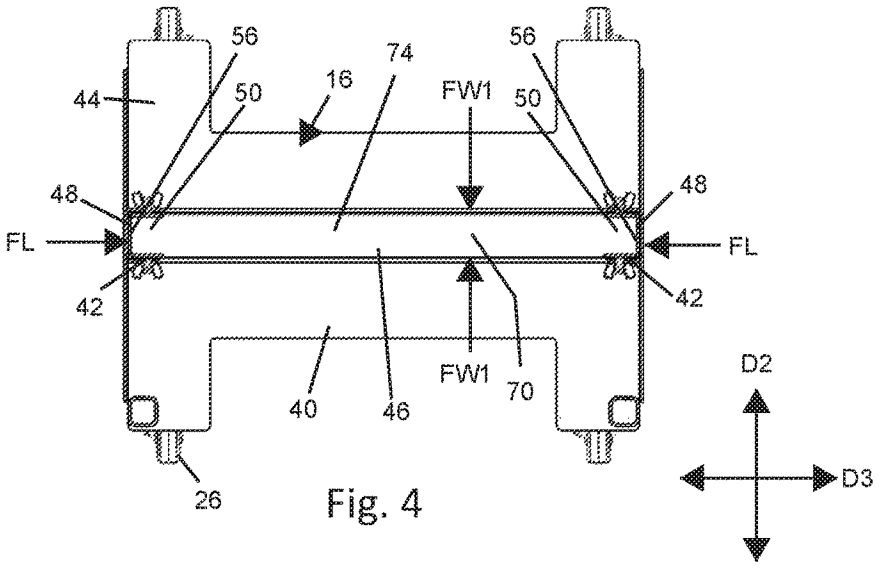
FIG. 4 is a top plan view of the frame illustrated in FIG. 3.
Figure 3:
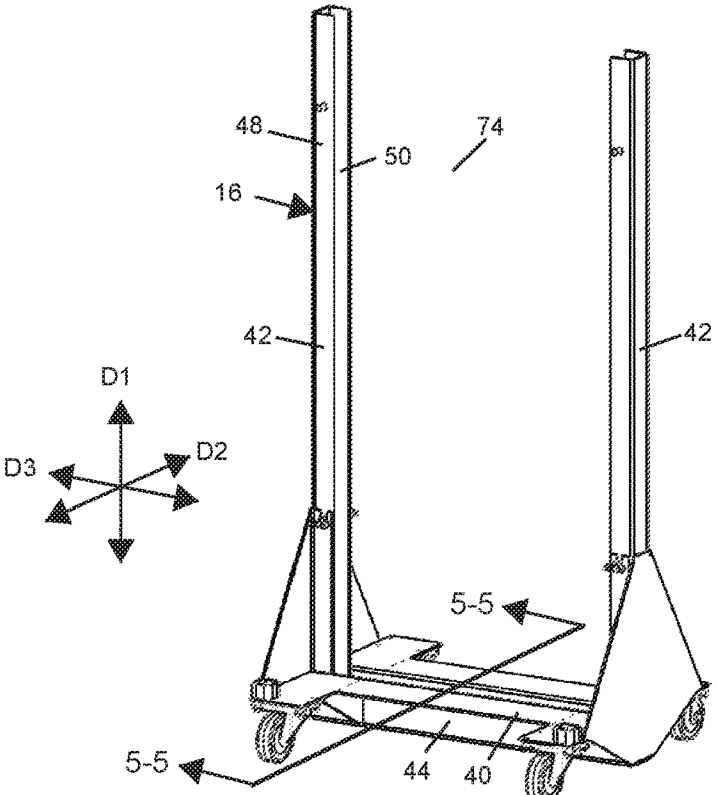
FIG. 3 is a front isometric view of a frame of the armored lectern illustrated in FIG. 1, according to one aspect of the disclosure.
Figure 5:
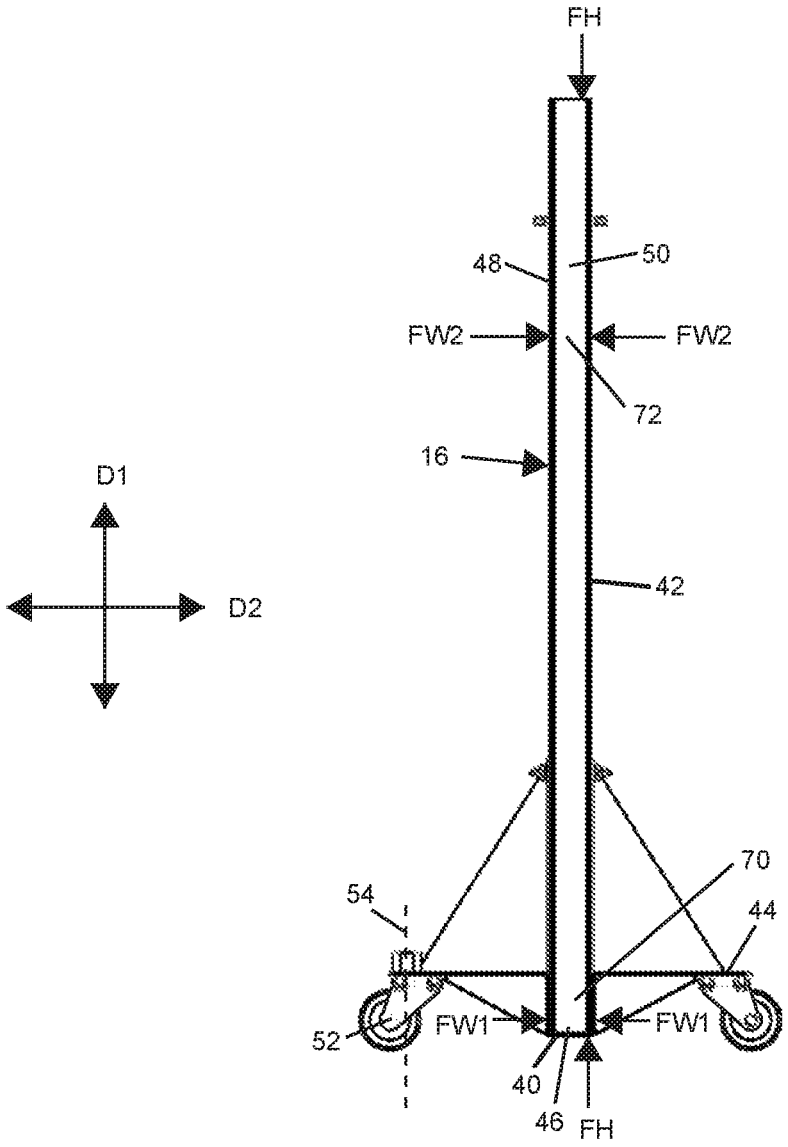
FIG. 5 is a cross-section view of the frame illustrated in FIG. 3, along line 5-5.
Figure 7:
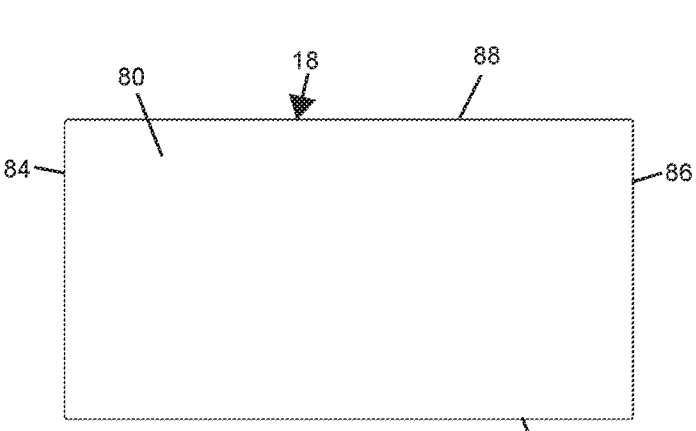
FIG. 7 is a front elevation view of the armored panel illustrated in FIG. 6.
Figure 6:
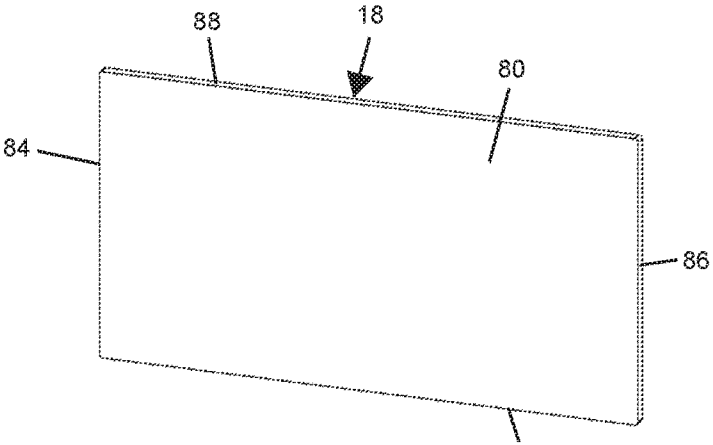
FIG. 6 is a front isometric view of an armored panel of the armored lectern illustrated in FIG. 1, according to one aspect of the disclosure.
Figure 9:
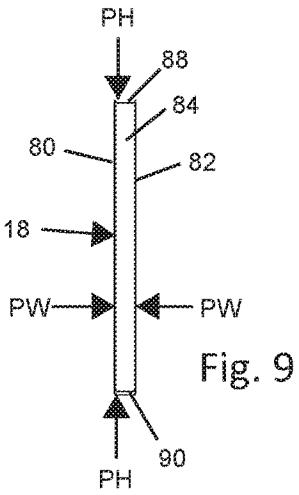
FIG. 9 is a side elevation view of the armored panel illustrated in FIG. 9.
Figure 8:
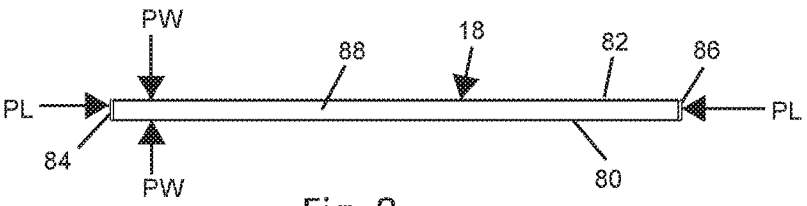
FIG. 8 is a top plan view of the armored panel illustrated in FIG. 6.
Figure 13:
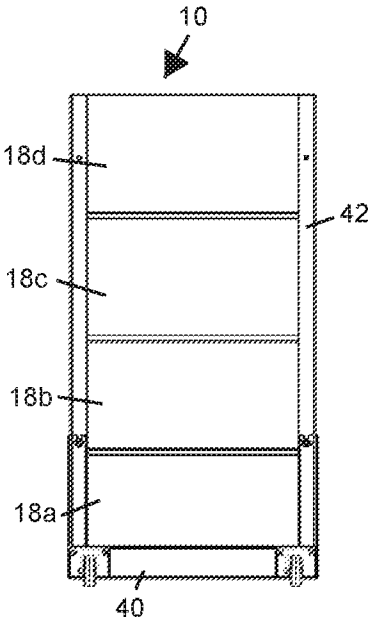
FIG. 13 is a front elevation view of the armored lectern illustrated in FIG. 1, in a fourth configuration.
Figure 12:
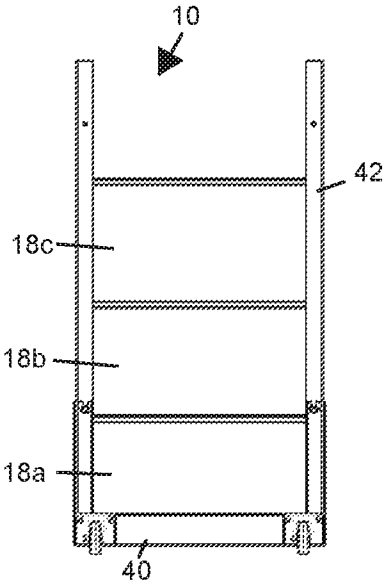
FIG. 12 is a front elevation view of the armored lectern illustrated in FIG. 1, in a third configuration.
Figure 11:
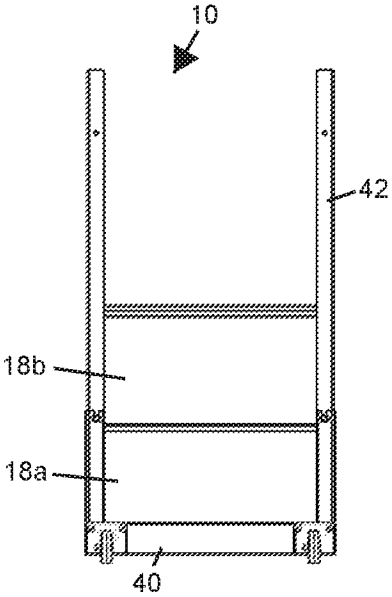
FIG. 11 is a front elevation view of the armored lectern illustrated in FIG. 1, in a second configuration.
Figure 10:
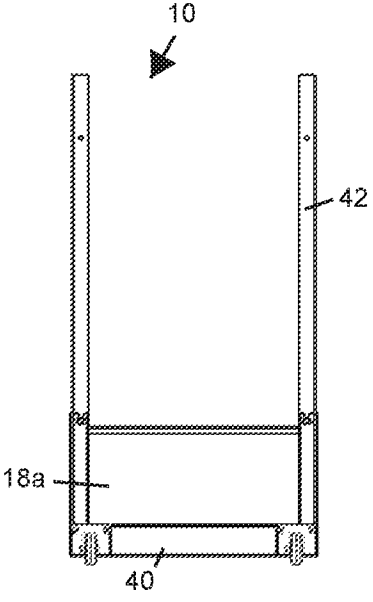
FIG. 10 is a front elevation view of the armored lectern illustrated in FIG. 1, in a first configuration.

Referring to FIGS. 3 to 5, the frame 16 includes a vertical support member 40 and a horizontal support member 42. The vertical support member 40 is configured to support the plurality of armor panels 18 such that the plurality of armor panels 18 are secured in position relative to the frame 16 with respect to a first direction D1. The first direction D1 may be a vertical direction, which is the direction substantially perpendicular to a surface upon which the armored lectern 10 is positioned. As shown in the illustrated embodiment, the vertical support member 40 includes a base plate 44, and the base plate 44 defines a base channel 46 configured to at least partially receive one of the plurality of armored panels 18. The base channel 46 includes a first gap 70 that defines a first frame width FW1. As shown in the illustrated embodiment, the first width FW1 may be measured along the second direction D2.

The horizontal support member 42 is configured to secure the plurality of armor panels 18 relative to the frame 16 with respect to a second direction D2. The second direction D2 may be a direction substantially parallel to the surface upon which the armored lectern 10 is positioned. As shown in the illustrated embodiment, the horizontal support member 42 includes a member, for example a channel member 48. The channel member 48 defines a side channel 50 configured to at least partially receive at least one of the plurality of armored panels 18. The side channel 50 includes a second gap 72 that defines a second frame width FW2. The first frame width FW1 and the second frame width FW2 may be substantially equal, as shown in the illustrated embodiment. According to another aspect of the disclosure, the first frame width FW1 may be greater than or less than, for example about half of, the second frame width FW2.

According to one aspect of the disclosure, the first frame width FW1, the second frame width FW2, or both may be measured in the second direction D2. The horizontal support member 42 may further be configured to secure the plurality of armor panels 18 relative to the frame 16 with respect to a third direction D3. As shown in the illustrated embodiment, the third direction D3 is substantially perpendicular to both the first direction D1 and the second direction D2. The horizontal support member 42 may include a pair of channel members 48 that each include a base surface 56. The frame 16 includes a third gap 74 that defines a frame length FL measured along the third direction D3 from the base surface 56 of one of the pair of channel members 48 to the base surface 56 of the other of the pair of channel members 48. As shown in the illustrated embodiment, the second gap 72 may define a frame height FH measured along the first direction D1 from the vertical support member 40 to the horizontal support member 42, for example from a location on the vertical support member 40 closest to the surface the armored lectern 10 is positioned upon to a location on the horizontal support member 42 farthest from the surface the armored lectern 10 is positioned upon.

Referring to FIGS. 1 to 5, the armored lectern 10 may further include a first shelf member 20, a second shelf member 22, one or more support members 24, a plurality of wheels 26, or any combination thereof. As shown in the illustrated embodiment, the plurality of wheels 26 may be attached to the base plate 44. The wheels 26 may be caster wheels attached to the frame 16 such that the wheels 26 are rotatable about a respective first axis 52 and a respective second axis 54 that is perpendicular to the first axis 52.

Referring to FIGS. 1 and 2, the first shelf member 20 is configured to support materials, for example notes or other reading materials, to be used by a person during a speech given at the armored lectern 10. As shown in the illustrated embodiment, the first shelf member 20 may be supported by the frame 16, positioned above each of the plurality of armored panels 18. The first shelf member 20 includes a first shelf surface 28 that faces away from each of the armored panels 18 and that is substantially flat. The first shelf surface 20 includes a first portion 30 that extends beyond the plurality of armored panels 18 toward the first side 12, and the first shelf 20 includes a second portion 32 that extends beyond the plurality of armored panels 18 toward the second side 14.

The first shelf member 20 is supported by the frame 16. According to one aspect of the disclosure, the first shelf member 20 is supported by the one or more support members 24 such that the first shelf member 20 is secured in position relative to the plurality of armored panels 18. The first shelf member 20 may be oriented substantially parallel to the surface upon which the armored lectern 10 is positioned, or the first shelf member 20 may be oriented at an angular offset (non-parallel) with respect to the surface upon which the armored lectern 10 is positioned.

The second shelf member 22 may be positioned between the first shelf member 20 and the base plate 44 with respect to the first direction D1. As shown in the illustrated embodiment, the second shelf member 22 extends away from the first side 12 of the frame 16. The horizontal support member 42, for example both of the channel members 48, may include an attachment mechanism configured to secure the second shelf member 22 to the frame 16. According to one aspect of the disclosure, the channel members 48 include slots and the second shelf member 22 includes projections that correspond to the slots such that when the projections are inserted into the slots the second shelf member is secured relative to the frame 16.

Referring to FIGS. 6 to 9, the armored panel 18 includes a first panel surface 80 that defines at least a portion of the first side 12 of the armored lectern 10 when the armored panel 18 is secured to the frame 16, and a second panel surface 82 that defines at least a portion of the second side 14 of the armored lectern 10 when the armored panel 18 is secured to the frame 16. The armored panel 18 defines a panel width PW measured from the first panel surface 80 to the second panel surface 82. The panel width PW is less than each of the first frame width FW1 and the second frame width FW2, such that the armored panel 18 is configured to be inserted into the first gap 70, the second gap 72, or both.

The armored panel 18 includes a first panel side 84 and a second panel side 86. The armored panel 18 defines a panel length PL measured from the first panel side 84 to the second panel side 86 along a direction that is perpendicular to the direction the panel width is measured along. The panel length PL is less than the frame length FL, such that the armored panel 18 is configured to be inserted into the third gap 74.

The armored panel 18 includes a top panel side 88 and a bottom panel side 90. The armored panel 18 defines a panel height PH measured from the top panel side 88 to the bottom panel side 90 along a direction that is perpendicular to both the direction that the panel width PW is measured along and the direction that the panel length PL is measured along.

The armored panel 18 is configured to prevent a ballistic projectile that strikes the first panel surface 80 from penetrating through the second panel surface 82. According to one aspect of the disclosure, the ballistic projectile that the armored panel 18 is configured to prevent from penetrating through the armored panel 18 includes .22 caliber bullets fired from a .22 caliber rifle. According to another aspect of the disclosure, the ballistic projectile that the armored panel 18 is configured to prevent from penetrating through the armored panel 18 includes .30-06 armor piercing caliber bullets fired from a .30-06 caliber rifle. According to another aspect of the disclosure, the armored panel 18 is rated for protection of level IV under the National Institute of Justice ratings for armor.

Referring to FIGS. 3 to 5 and 10 to 13, a method of assembling the armored lectern 10 includes the steps of: positioning a first armored panel 18*a* within the first gap 70 such that the first armored panel 18*a* abuts the vertical support member 40, and positioning a second armored panel 18*b* within a first portion of the second gap 72 such that the first armored panel 18*a* is secured to the second armored panel 18*b*. According to one aspect of the disclosure, either or both of the securing steps may include abutting the respective armored panel 18 with the horizontal support member 42. The method may further include the steps of positioning a third armored panel 18*c* within a second portion of the second gap 72 such that the second armored panel 18*b* is secured to the third armored panel 18*c*, and positioning a fourth armored panel 18*d* within a third portion of the second gap 72 such that the third armored panel 18*c* is secured to the fourth armored panel 18*d*. The method of assembling the armored lectern 10 may further include the steps of: securing the first armored panel 18*a*, the second armored panel 18*b*, the third armored panel 18*c*, the fourth armored panel 18*d*, or any combination thereof relative to the frame 16.

Figure 14:
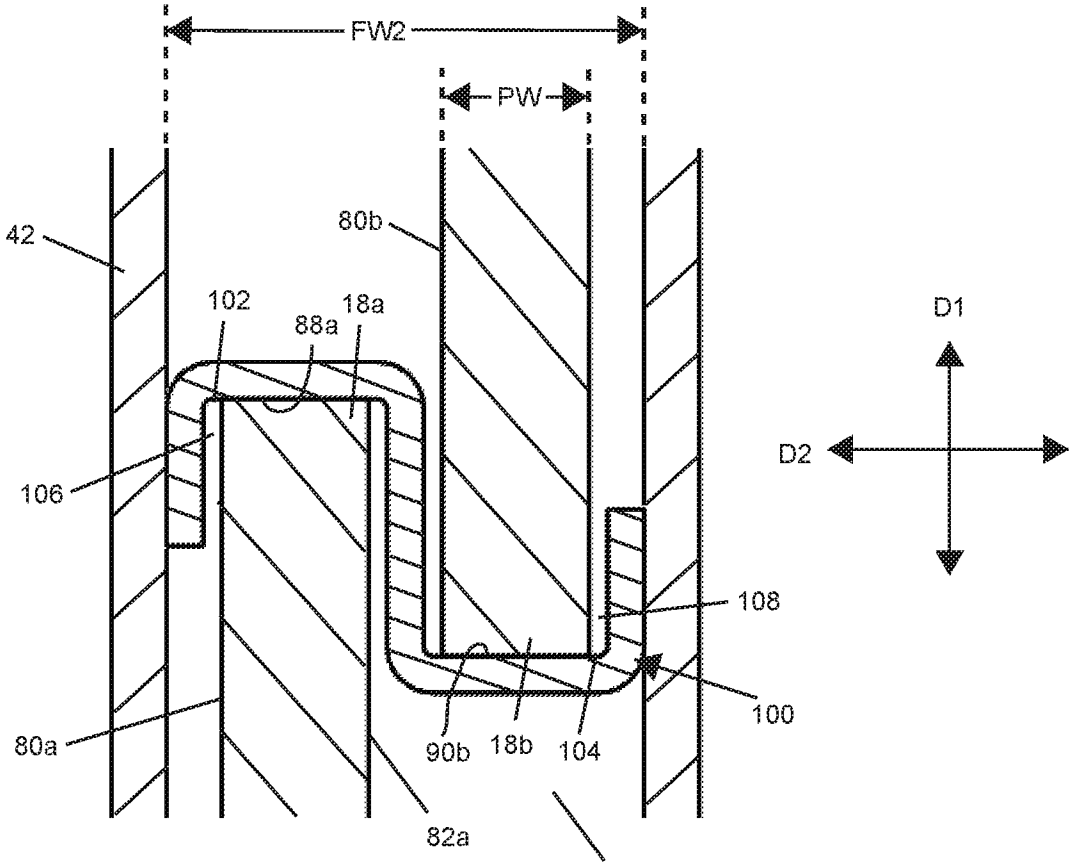
FIG. 14 is a cross-sectional side view of a portion of the armored lectern illustrated in FIG. 1.

Referring to FIG. 14, the armored lectern 10 may include a coupling member, for example a bracket 100 configured to couple adjacent ones of the plurality of armored panels 18. The bracket 100 includes a first bracket surface 102 that faces toward the surface upon which the armored lectern 10 is positioned, and the bracket 100 includes a second bracket surface 104 that faces opposite the first bracket surface, for example away from the surface upon which the armored lectern 10 is positioned.

According to one aspect of the disclosure the armored lectern 10 defines an assembled configuration in which a portion of the first armored panel 18*a* is positioned within the second gap 72 such that the first panel surface 80*a* of the first armored panel 18*a* faces a direction, for example one of the directions that makes up the second direction D2; a first portion of the second armored panel 18*b* is positioned within the second gap 72 such that the first panel surface 80*b* of the second armored panel 18*a* faces the same direction as the first panel surface 80*a* of the first armored panel 18*a*, and a second portion of the first panel surface 80*b* of the second armored panel 18*b* faces the second panel surface 82*a* of the first armored panel 18*a*.

The armored lectern 10 may include additional armored panels 18. According to one aspect of the disclosure, the armored lectern 10 may include the third armored panel 18*c*, and in the assembled configuration the a first portion of the third armored panel 18*c* is positioned within the second gap 72 such that the first panel surface 80*c* of the third armored panel 18*c* faces the same direction as the first panel surface

80*a* of the first armored panel, and a third portion of the first panel surface 80*b* of the second armored panel 18*b* faces the second panel surface 82*c* of the third armored panel 18*c*. Additional armored panels 18*d* may be added in a continued, alternating pattern (left, right, left, right, as shown in FIG. 14). Such an alternating arrangement removes seems between adjacent ones of the armored panels 18. Each "joint" of adjacent ones of the armored panels 18 includes an overlap of the two adjacent armor panels 18.

According to another aspect of the disclosure, the plurality of armor panels 18 may be arranged vertically within the second gap 72 such that there is no overlap between adjacent ones of the armored panels 18.

According to one aspect of the disclosure, the bracket 100 defines a first channel 106 configured to receive one of the plurality of armored panels 18, and the bracket 100 defines a second channel 108 configured to receive another of the plurality of armored panels 18. As shown in the illustrated embodiment, the bracket 100 is configured to couple the first armored panel 18*a* and the second armored panel 18*b* such that first armored panel 18*a* and the second armored panel 18*b* overlap with respect to the first direction D1. In other words, a straight line in the second direction D2 will intersect a portion of both the first armored panel 18*a* and the second armored panel 18*b*.

Referring to FIGS. 1 to 14, the armored lectern 10 defines a first configuration in which the a first portion of the first armored panel 18*a* is positioned within the first gap 70, a second portion of the first armored panel 18*a* is positioned within the second gap 72, a portion of the second armored panel 18*b* is positioned within the second gap 72, the bottom panel side 90*a* of the first armored panel 18*a* is positioned closer to the vertical support member 40 than the bottom panel side 90*b* of the second armored panel 18*b* is to the vertical support member 40, and the bottom panel side 90*b* of the second armored panel 18*b* is positioned closer to the vertical support member 40 than the top panel side 88*a* of the first armored panel 18*a*.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the present disclosure as defined by the claims.

What is claimed:

1. An armored lectern configured to protect an area on a first side of the armored lectern from ballistic projectiles fired from a second side of the armored lectern that is opposite the first side with respect to a first direction, the armored lectern comprising:

a frame including a first channel member, the first channel member having a first side wall and a second side wall, the second side wall spaced from the first side wall in the first direction by a frame width, the first channel member defining a gap between the first side wall and the second side wall;

a first armored panel having a first panel surface and a second panel surface opposite the first panel surface, the first armored panel configured to prevent a ballistic projectile that strikes the first panel surface from penetrating through the second panel surface, the first armored panel defining a first panel width measured from the first panel surface to the second panel surface along the first direction;

a second armored panel having a first panel surface and a second panel surface opposite the first panel surface of the second armored panel, the second armored panel configured to prevent a ballistic projectile that strikes the first panel surface of the second armored panel from penetrating through the second panel surface of the second armored panel, the second armored panel defining a second panel width measured from the first panel surface of the second armored panel to the second panel surface of the second armored panel along the first direction;

wherein the frame width is greater than a summation of the first panel width and the second panel width, and the armored lectern defines an assembled configuration in which: 1) a portion of the first armored panel is positioned within the gap such that the first panel surface of the first armored panel faces the first side, 2) a first portion of the second armored panel is positioned within the gap such that the first panel surface of the second armored panel faces the first side, and 3) a second portion of the first panel surface of the second armored panel faces the second panel surface of the first armored panel.

2. The armored lectern of claim 1, wherein the frame further comprises a vertical support member configured to support both the first armored panel and the second armored panel such that when the armored lectern is in the assembled configuration the vertical support member blocks movement of both the first armored panel and the second armored panel in a second direction which is substantially perpendicular to the first direction.

3. The armored lectern of claim 2, wherein in the assembled configuration: 1) the first armored panel abuts the vertical support member, and 2) the second armored panel is spaced from the vertical support member with respect to the second direction.

4. The armored lectern of claim 2, wherein the first armored panel includes a first bottom panel side and a first top panel side opposite the bottom panel side along the second direction, the second armored panel includes a second bottom panel side and a second top panel side opposite the second bottom panel side along the second direction, and in the assembled configuration: the first and second bottom panel side each face the vertical support member, 2) the first and second top panel sides each face away from the vertical support member, 3) the first bottom panel side is positioned closer to the vertical support member with respect to the second direction than the second bottom panel side is positioned from the vertical support member with respect to the second direction, and 4) the second bottom panel side is positioned closer to the vertical support member with respect to the second direction than the first top panel side is positioned from the vertical support member with respect to the second direction.

5. The armored lectern of claim 2, wherein the frame further comprises a second channel member that includes a first side wall of the second channel member and a second side wall of the second channel member spaced from the first side wall of the second channel member in the first direction by the frame width.

6. The armored lectern of claim 2, further comprising a coupling member configured to secure the first armored panel relative to the second armored panel, the coupling member including a first surface and a second surface that faces opposite the first surface, wherein in the assembled configuration: 1) the first surface abuts one of the first armored panel and the second armored panel, 2) the first surface faces the second direction, 3) the second surface abuts the other of the first armored panel and the second armored panel, and 4) the second surface faces in a direction opposite the second direction.

7. The armored lectern of claim 1, further comprising a third armored panel having a first panel surface and a second panel surface opposite the first panel surface of the third armored panel, the third armored panel configured to prevent a ballistic projectile that strikes the first panel surface of the third armored panel from penetrating through the second panel surface of the third armored panel, wherein in the assembled configuration: 1) a first portion of the third armored panel is positioned within the gap such that the first panel surface of the third armored panel faces the first side, and 2) a third portion of the first panel surface of the second armored panel faces the second panel surface of the second armored panel.

8. The armored lectern of claim 7, further comprising a fourth armored panel having a first panel surface and a second panel surface opposite the first panel surface of the fourth armored panel, the fourth armored panel configured to prevent a ballistic projectile that strikes the first panel surface of the fourth armored panel from penetrating through the second panel surface of the fourth armored panel, wherein in the assembled configuration: 1) a first portion of the fourth armored panel is positioned within the gap such that the first panel surface of the fourth armored panel faces the first side, and 2) a second portion of the first panel surface of the fourth armored panel faces the second panel surface of the third armored panel.

9. An armored lectern comprising:

a frame including:

a first channel member including a first side wall and a second side wall, the second side wall spaced from the first side wall in a first direction such that the first channel member defines a first gap between the first side wall and the second side wall;

a second channel member spaced from the first channel member along a second direction that is substantially perpendicular to the first direction, the second channel member including a third side wall and a fourth side wall, the third side wall spaced from the fourth side wall in the first direction such that the second channel member defines a second gap between the third side wall and the fourth side wall; and a vertical support member including a fifth side wall and a sixth side wall, the vertical support member configured to be coupled to the first channel member and the second channel member such that the fifth side wall is spaced from the sixth side wall in the first direction, and the vertical support member defines a third gap between the fifth side wall and the sixth side wall, a first armored panel configured to be positioned at least partially within the third gap, the first armored panel including a first panel surface and a second panel surface opposite the first panel surface along the first direction when the first armored panel is positioned at least partially within the third gap, the first armored panel configured to prevent a ballistic projectile that strikes the first panel surface from penetrating through the second panel surface;

a second armored panel configured to be positioned partially within both the first gap and the second gap, the second armored panel including a first panel surface and a second panel surface opposite the first panel surface of the second armored panel, the second armored panel configured to prevent a ballistic projectile that strikes the first panel surface of the second armored panel from penetrating through the second panel surface of the second armored panel;

wherein the armored lectern defines an assembled configuration in which at least a portion of the second armored panel is positioned farther from the vertical support member with respect to a third direction, which is substantially perpendicular to both the first direction and the second direction, than an entirety of the first armored panel is from the vertical support member with respect to the third direction.

10. The armored lectern of claim 9, wherein the portion of the second armored panel is a first portion of the second armored panel, and in the assembled configuration a second portion of the second armored panel is positioned closer to the vertical support member with respect to the third direction than a portion of the first armored panel is from the vertical support member with respect to the third direction.

11. The armored lectern of claim 9, further comprising a third armored panel configured to be positioned at least partially within the both the first gap and the second gap, the third armored panel including a first panel surface and a second panel surface opposite the first panel surface, the first armored panel configured to prevent a ballistic projectile that strikes the first panel surface of the third armored panel from penetrating through the second panel surface of the third armored panel, wherein in the assembled configuration a portion of the third armored panel is positioned farther from the vertical support member with respect to the third direction than an entirety of the second armored panel is positioned from the vertical support member with respect to the third direction.

12. The armored lectern of claim 11, wherein the portion of the portion of the third armored panel is a first portion of the third armored panel, and in the assembled configuration a second portion of the third armored panel is positioned closer to the vertical support member with respect to the third direction than a third portion of the second armored panel is from the vertical support member with respect to the third direction.

13. A method of assembling an armored lectern configured to protect an area on a first side of the armored lectern from projectiles fired from a second side of the armored lectern that is opposite the first side with respect to a first direction, the method including the steps of:

positioning a portion of a first armored panel within a gap of a first channel member such that a first panel surface of the first armored panel faces the first side and a second panel surface of the first armored panel faces the second side, the gap defined between a first side wall of the first channel member and a second side wall of the first channel member spaced from the first side wall of the first channel member in the first direction;

positioning a portion of a second armored panel within the gap of the first channel member such that: 1) a first portion of the first panel surface of the second armored panel faces the first side, and 2) a second portion of the first panel surface of the second armored panel faces the second panel surface of the first armored panel.

14. The method of claim 13, further comprising the steps of:

positioning a second portion of the second armored panel farther from a surface upon which the armored lectern is positioned with respect to a second direction that is perpendicular to the first direction, then an entirety of the first armored panel is from the surface with respect to the second direction; and positioning a third portion of the second armored panel closer to a surface upon which the armored lectern is positioned with respect to a second direction that is perpendicular to the first direction, then a second portion of the first armored panel is from the surface with respect to the second direction.

15. The method of claim 14, wherein each of the positioning steps include sliding the respective armored panel in the second direction.

16. The method of claim 14, further comprising the step of abutting a first surface of a coupling member with the first armored panel such that the first surface faces in the second direction.

17. The method of claim 16, further comprising the step of abutting the second armored panel with a second surface of the coupling member such that the second surface faces in a direction opposite the second direction.

18. The method of claim 14, further comprising the steps of:

positioning a portion of the first armored panel within a gap of a second channel member that is spaced from the first channel member in a third direction that is perpendicular to both the first direction and the second direction, thereby facing a first panel surface of the third armored panel toward the first side and a second panel surface of the third armored panel toward the second side, the gap of the second channel member defined between a first side wall of the second channel member and a second side wall of the second channel member spaced from the first side wall of the first channel member in the first direction.

19. The method of claim 18, further comprising the steps of abutting a first surface of a coupling member with the first armored panel such that the first surface faces in the second direction.

20. The method of claim 19, further comprising the step of abutting the second armored panel with a second surface of the coupling member such that the second surface faces in a direction opposite the second direction.

* * * * *